US010244859B2

(12) United States Patent
Robertson et al.

(10) Patent No.: US 10,244,859 B2
(45) Date of Patent: Apr. 2, 2019

(54) BROOM ATTACHMENT, BROOM ASSEMBLY AND METHOD FOR USE THEREOF

(71) Applicants: Balais Nomad Inc., Mirabel (CA); Les Brosses Henault Inc., Saint-Hyacinthe (CA)

(72) Inventors: Christian Robertson, Mirabel (CA); Sylvain Henault, Saint-Hyacinthe (CA)

(73) Assignees: Balais Nomad Inc., Mirabel (CA); Les Brosses Henault inc., Saint-Hyacinthe (CA)

( * ) Notice: Subject to any disclaimer, the term of this patent is extended or adjusted under 35 U.S.C. 154(b) by 463 days.

(21) Appl. No.: 15/142,415

(22) Filed: Apr. 29, 2016

(65) Prior Publication Data

US 2017/0311708 A1 Nov. 2, 2017

(51) Int. Cl.

| | |
|---|---|
| ***A46B 13/00*** | (2006.01) |
| ***A46D 1/00*** | (2006.01) |
| ***B24B 7/18*** | (2006.01) |
| ***E01H 1/05*** | (2006.01) |
| ***A46B 3/14*** | (2006.01) |

(52) U.S. Cl.

CPC ..... *A46D 1/0207* (2013.01); *A46B 3/14* (2013.01); *A46B 13/008* (2013.01); *B24B 7/188* (2013.01); *E01H 1/05* (2013.01); *A46B 2200/302* (2013.01); *A46B 2200/3066* (2013.01)

(58) Field of Classification Search

CPC ..... A46D 1/0207; B24B 7/188; A46B 3/14; A46B 13/001; A46B 13/008; A46B 2200/302; A46B 2200/3066; E01H 1/05

USPC ..... 15/180

See application file for complete search history.

(56) References Cited

U.S. PATENT DOCUMENTS

| | | | | |
|---|---|---|---|---|
| 1,693,908 | A * | 12/1928 | Marshall | A47L 11/161 15/180 |
| 2,168,692 | A * | 8/1939 | Vidal | A47L 11/30 15/180 |
| 3,353,201 | A * | 11/1967 | Horton | A46B 13/008 15/168 |
| 3,370,312 | A | 2/1968 | Tamny et al. | |
| 3,875,607 | A * | 4/1975 | Rosseau | A46B 13/008 15/180 |

(Continued)

OTHER PUBLICATIONS

Wharf Hog Street Sweeper Brooms, Topper Manufacturing, Sturtevant—USA, http://www.streetsweeperbrooms.com/.

*Primary Examiner* — Weilun Lo

(74) *Attorney, Agent, or Firm* — Price Heneveld LLP

(57) ABSTRACT

A broom attachment is provided for a rotary sweeper assembly that includes a broom mount and a broom unit mountable to the broom mount. The broom attachment includes a plurality of broom attachment bristles and a support member having a retained portion and a retaining portion. The plurality of bristles extend from the retaining portion and the retained portion is operatively mountable to at least one of the broom mount and the broom unit. A broom assembly includes at least one broom attachment. When the broom attachment is operatively mounted to the broom mount, the broom attachment bristles are positioned at a greater radial distance away from an axis of rotation than the cleaning bristles of the broom unit. A method of assembling a broom attachment to a broom mount includes operatively mounting the retained portion to the broom mount.

23 Claims, 8 Drawing Sheets

(56) References Cited

U.S. PATENT DOCUMENTS

| | | | | | |
|---|---|---|---|---|---|
| 4,186,459 | A * | 2/1980 | Wulff | A47L 11/164 | 15/180 |
| 4,219,898 | A * | 9/1980 | Presby | A47L 11/164 | 15/180 |
| 4,457,040 | A * | 7/1984 | Hettes | A46B 9/02 | 15/180 |
| 4,615,064 | A * | 10/1986 | Alvin | A46B 3/14 | 15/180 |
| 4,771,498 | A * | 9/1988 | Torta | A47L 11/16 | 15/180 |
| 4,998,314 | A * | 3/1991 | Borofsky | A47L 11/162 | 15/180 |
| 6,457,202 | B1 * | 10/2002 | Torres | A46B 7/04 | 15/180 |
| 7,025,834 | B2 | 4/2006 | Joynt et al. | | |
| 2001/0012753 | A1 * | 8/2001 | Cox | A46B 13/001 | 451/464 |
| 2003/0172484 | A1 * | 9/2003 | Lendabarker | A46B 3/00 | 15/180 |

* cited by examiner

BROOM ATTACHMENT, BROOM ASSEMBLY AND METHOD FOR USE THEREOF

TECHNICAL FIELD

The technical field generally relates to [a] rotary brooms and more particularly to a broom attachment that may be used in combination with existing rotary brooms, part of street sweepers for example and without limitation.

BACKGROUND

A rotary sweeper is a mechanized device used for cleaning surfaces, such as streets and sidewalks. The street sweeper may be vehicle-based, such as a mechanized street sweeping assembly being mounted onto a truck. The mechanized sweeping assembly may also be mounted onto a walk-behind street sweeper being operated by a human operator.

In the case of a street sweeper, the rotary sweeping assembly for cleaning the outdoor surface includes a mechanical broom, also called a "gutter broom". The gutter broom typically includes a plurality of cleaning bristles that are arranged circularly. The gutter broom is mounted onto a broom mount of the mechanized street sweeping assembly. Rotation of the broom mount within the mechanized street sweeping assembly causes rotation of the gutter broom, which provides in part the cleaning action of any surface requiring cleaning.

The gutter broom may be dismounted from the broom mount. This may be done to replace a worn out gutter broom or to use a different gutter broom for a different cleaning applications.

SUMMARY

According to a general aspect, there is provided a broom attachment for a rotary sweeper assembly that includes a broom mount and a broom unit mountable to the broom mount. The broom attachment comprises a plurality of broom attachment bristles, and a support member having a retained portion and a retaining portion, the plurality of bristles extending from the retaining portion and the retained portion being operatively mountable to at least one of the broom mount and the broom unit.

According to another general aspect, there is provided a broom assembly that includes at least one broom attachment as described herein according to various embodiments, the broom mount having an axis of rotation, and the broom unit provided with cleaning bristles. The broom attachment and the broom unit are both operatively mounted to the broom mount. The broom attachment bristles are positioned at a greater radial distance away from the axis of rotation of the broom mount than the cleaning bristles of the broom unit.

According to yet another general aspect, there is provided a method of assembling a broom attachment to a broom mount of a street sweeper. The method comprises providing at least one broom attachment as described herein according to various embodiments, and operatively mounting the retained portion of the least one broom attachment to the broom mount.

In an embodiment, the retained portion is directly mountable to at least one of the broom mount and the broom unit.

In an embodiment, the retained portion of the support member has a broom mount surface for facing the broom mount, the broom mount surface being operatively mountable to the broom mount.

In an embodiment, the retained portion of the support member has a broom unit surface for facing the broom unit, the broom unit surface being operatively mountable to the broom unit.

In an embodiment, the retained portion of the support member comprises a metallic plate.

In an embodiment, the retaining portion of the support member has a slot formed therein for receiving a broom fastener.

In an embodiment, the slot is elongated and extends radially relative to the broom unit.

In an embodiment, the retained portion is sized, shaped and configured to be pinched between the broom mount and the broom unit.

In an embodiment, the retained portion comprises a tooth for gripping the broom unit.

In an embodiment, the retaining portion comprises an opening for receiving upper extremities of the broom attachment bristles.

In an embodiment, the retaining portion comprises opposed sidewalls, the broom attachment bristles being secured to the retaining portion by pressing the upper extremities between said opposed sidewalls.

In an embodiment, the retaining portion comprises a tubular body deformed into an oval-profile cylinder.

In an embodiment, the retained portion and the retaining portion define an inner angle of between about 90 degrees and about 135 degrees.

In an embodiment, the retained portion and the retaining portion are welded to one another.

In an embodiment, the bristles are oriented transversely to the retained portion.

In an embodiment, the bristles are arranged in at least one row.

In an embodiment, the bristles are made of steel cables.

In an embodiment, the bristles are made of compressed steel cables.

In an embodiment, the bristles have a diameter of about 3/16 of an inch to about ½ of an inch.

In an embodiment, the broom attachment weighs less than about 2.5 lbs.

In an embodiment, the broom mount comprises a cylindrical drive plate.

In an embodiment, the broom unit comprises one of an annular member and a plurality of arcuate broom sections.

In an embodiment, the broom assembly includes a broom fastener.

In an embodiment, the broom fastener is a bolt, the bolt projecting through the broom mount, the retained portion of the broom attachment and the broom unit.

In an embodiment, the bolt successively projecting through the broom mount, the retained portion and the broom unit, thereby pinching the broom attachment between the broom mount and the broom unit.

In an embodiment, a distance of the bristles of the broom attachment away from the axis of rotation of the broom mount is adjustable.

In an embodiment, the broom attachment bristles extend outwardly from the broom mount relative to the cleaning bristles of the broom unit.

In an embodiment, the bristles are arranged in at least one row and wherein the at least one row is oriented tangentially to the axis of rotation.

In an embodiment, a plurality of broom attachments are operatively mounted to the broom mount, the broom attachments being spaced angularly apart about the axis of rotation of the broom mount.

In an embodiment, the plurality of broom attachments are positioned to cover less than a full circumference about the axis of rotation of the broom mount.

In an embodiment, the broom mount is a circular drive plate having opposed top and bottom faces, the retained portion being directly mounted to either one of said top and bottom faces.

In an embodiment, the operative mounting of the retained portion comprises positioning the retained portion between the broom mount and the broom unit, wherein fastening the broom unit to the broom mount causes the retained portion to be pinched between the broom unit and the broom mount.

In an embodiment, operative mounting the retained portion comprises projecting a broom fastener through a slot formed in the retained portion and wherein the broom and the broom mount of the street sweeper is fastened by the broom fastener.

In an embodiment, operative mounting of the retained portion of the broom attachment further comprises adjusting a position of the broom fastener within the slot to adjust a radial distance of the broom attachment bristles from an axis of rotation of the broom mount.

In an embodiment, a plurality of broom attachments are operatively mounted, the broom attachments being spaced angularly apart about the axis of rotation of the broom mount.

In an embodiment, the plurality of broom attachments are positioned to cover less than a full circumference about the axis of rotation of the broom mount.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

A first element being "directly mounted" to another element, or variants of this expression, herein refers to the first element being directly connected to another element. The direct connection may be provided using a coupling element, such as fastener, that operates to connect the first element with the other element.

A first element being "operatively mounted" to another element, or variants of this expression, herein refers to the first element being directly connected to another element or the first element being connected to the other element through one or more intermediate elements. The first element being "operatively mounted" to the other element may encompass, but does not necessarily include, the first element being "directly mounted" to the other element.

Figure 1A:
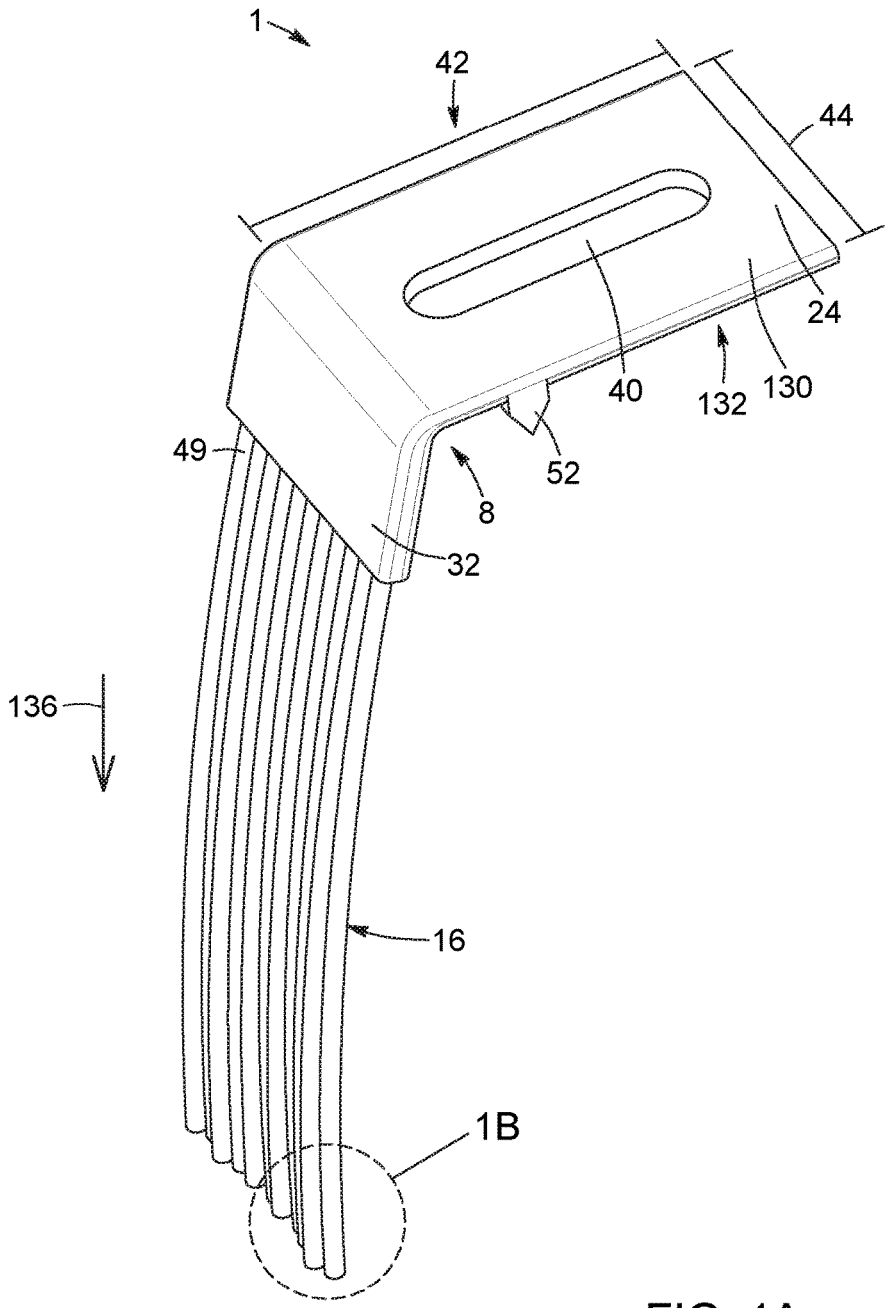
FIG. 1A illustrates a perspective view of a broom attachment according to one example embodiment, which is in this case a gutter broom attachement.

Referring now to FIG. 1A, therein illustrated is a perspective view of a gutter broom attachment 1 according to one example embodiment. The gutter broom attachment 1 includes a support member 8 and a plurality of broom attachment bristles 16 extending from the support member 8. While the example provided is a gutter broom attachment, it is possible that the broom attachment of the present invention be used in other applications, such as for indoor cleaning applications, for example, such as floor cleaning or surface buffing. It is also possible to use the broom attachment of the present invention with other types of outdoor sweeping assembly, for example for the cleaning of buildings, pipes or bridges.

The support member 8 comprises a retained portion 24 and a retaining portion 32. The retained portion 24 corresponds to a portion of the support member 8 that is adapted to be operatively mounted to a broom unit and a broom mount of a mechanized sweeping assembly, such as for example a street sweeper or a floor sanding machine, without limitation. Other examples include any articulated arms provided with a broom mount. More particularly, the retained portion 24 is adapted to be operatively mounted to the broom and/or the broom mount of the mechanized sweeping assembly such that the support member 8 and the bristles 16 extending therefrom are rotated with rotation of the broom mount when the retained portion 24 is mounted. The retained portion 24 may be further adapted to be directly mounted to at least one of the broom mount and the broom unit.

The retaining portion 32 corresponds to a portion of the support member 8 that physically retains the broom attachment bristles 16 to the support member 8. The retained and retaining portions 24, 32 may be integrally formed form the same part, or alternately, be made of two or more parts, assembled, affixed, attached or soldered.

The retained portion 24 includes a plurality of surfaces, of which one of the surfaces may be defined as a broom mount surface. The broom mount surface corresponds to the surface of the retained portion 24 that is operatively mountable to the broom mount. As described elsewhere herein, the broom mount surface of the retained portion 24 may vary depending on the manner in which the retained portion 24 is operatively mounted to at least one of the broom unit and the broom mount. The retained portion 24 may have a top surface or face, and a bottom surface of face. In some embodiments, the top surface of the retained portion is mounted underneath the broom mount. In other possible embodiments, the bottom surface is mountable on top of the broom mount. It is too be understood that the broom attachment does not need to be in direct contact with the broom mount, and that other fixing or retaining elements may be used in between the broom attachment and the broom mount. Yet in other embodiments, the retained portion can be mountable onto a broom unit of a broom assembly, the broom unit being in turn mounted to the broom mount. It is to be understood that the broom attachment of the present invention can be mounted in any possible manner allowing it to rotate along with the rotary broom assembly. Yet in other possible embodiments, the broom attachment can be mounted to a broom mount which is not necessarily part of a rotary assembly. For example, the broom attachment of the present invention can be mounted to the broom mount of an assembly having a back and forth motion, rather than a rotary motion. Preferably, the broom attachment is removably affixed to the broom mount and/or broom unit(s), but it is possible to permanently affix the broom attachment to the broom mount and/or broom unit(s), by soldering it to the broom mount and/or to a broom unit.

Similarly, one of the surfaces of the retained portion 24 may be defined as a broom unit surface. The broom unit surface corresponds to the surface of the retained portion that is operatively mountable to the broom unit. As described elsewhere herein, the broom unit surface of the retained portion 24 may vary depending on the manner in which the retained portion 24 is mounted to at least one of the broom unit and the broom mount.

According to one example embodiment, the retained portion 24 of the support member 8 includes a body having at least one opening 40 formed therein. The opening 40 is sized to receive a fastener for securing the retained portion 24 to at least one of the broom unit and broom mount of a mechanized street sweeping assembly. In other embodiments, the retaining portion can be provided with more than one slot or opening. It can also include a protrusion insertable in a corresponding slot of the broom mount and/or broom units. Different types of retaining means and attachments can be considered, such as a rail system including a protrusion slidable between rails; a snap fit system, etc.

Figure 1B:
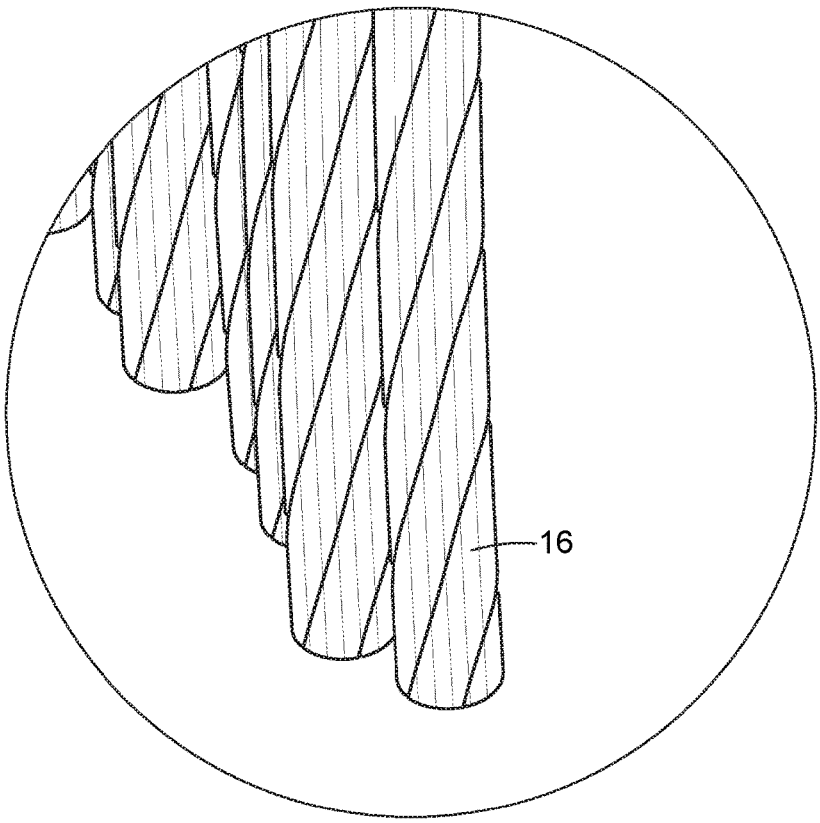
FIG. 1B illustrates an enlarged view of the broom attachment bristles of the gutter broom attachment according to one example embodiment.

For example, and as illustrated in FIG. 1, the opening 40 is an elongated slot 40. The position of the fastener within the elongated slot 40 may be adjusted so as to adjust a position of the support member 8 relative to the broom unit and/or broom mount when the retained portion 24 is operatively or directly mounted. For example, the elongated shaped of the slot 40 may be useful for aligning the elongated slot 40 with different sizes or models of broom units or broom mounts.

The retained portion 24 may have a plate-shaped body. For example, the retained portion may include a metallic plate, which may be a piece of sheet metal. Of course, other types of materials can be considered, such as plastic or wood. The elongated slot 40 may be formed by tooling the plate-shaped body according to various methods known in the art. Alternatively, the retained portion 24 having the elongated slot 40 may be formed by molding methods known in the art.

According to one example embodiment, and as illustrated in FIG. 1, the plate-shaped body of the retained portion 24 is elongated to have a length 42 that is greater than a width 44. The elongated slot 40 may extend in the lengthwise direction of the plate-shaped body. However, the retained portion 24 may have other shapes, such as having a dimension in a direction corresponding to an angular direction when operatively mounted to the broom unit and gutter broom that is greater to a dimension in a direction corresponding to a radial direction when so operatively mounted. In other examples, the retained portion 24 may have an arcuate shape.

Figure 2A:
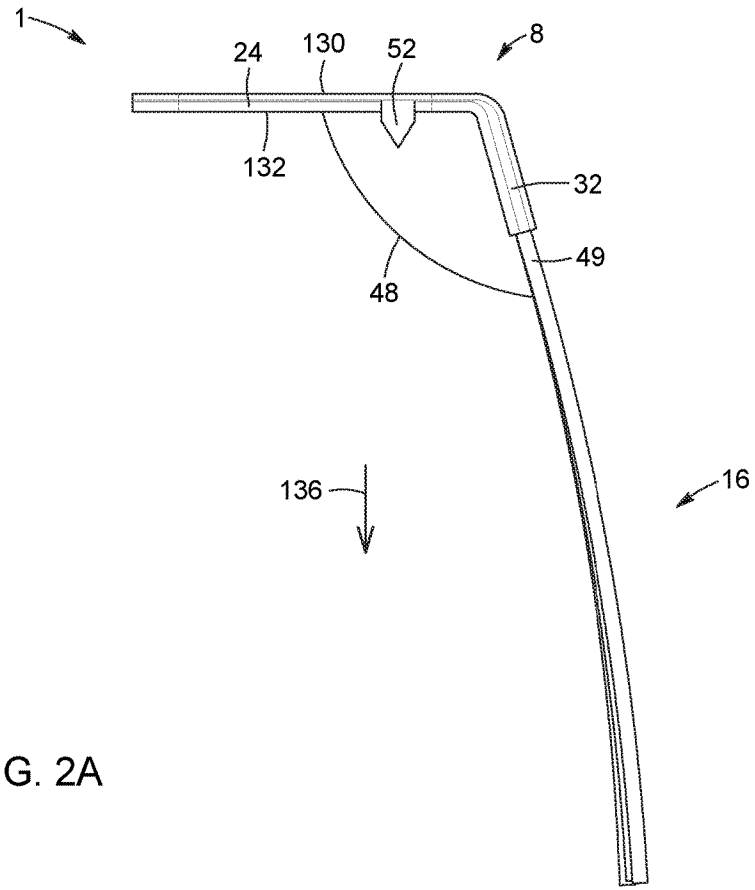
FIG. 2A illustrates a side elevation view of the broom attachment of FIG. 1A.

According to an example embodiment, the broom attachment bristles 16 are oriented transversely to the retained portion 24 of the support member 8. For example, the broom attachment bristles 16 may be oriented perpendicularly to the retained portion 24. Alternatively, and as illustrated, the broom attachment bristles 16 are oriented obliquely with respect to the retained portion 24 to define an inner angle 48 that is greater than 90 degrees (FIG. 2A). For example, the inner angle 48 may be between about 90 degrees and about 135 degrees.

The orientation of the broom attachment bristles 16 with respect to the retained portion 24 is configured based on the manner in which the retained portion 24 is to be operatively mounted to the at least one of the broom unit and the broom mount of the mechanized street sweeping assembly. The orientation of the retained portion 24 is configured to ensure a proper orientation of the broom attachment bristles 16 when the retained portion 24 is operatively mounted.

According to an example embodiment, the retaining portion 32 is also oriented transversely to the retained portion 24 of the support member 8. For example, and as illustrated in FIGS. 1 and 2, the retained portion 24 is oriented with respect to the retaining portion 32 to also define an angle that substantially corresponds to inner angle 48. Accordingly, the bristles 16 are substantially aligned with the retaining portion 32 of the support member 8.

The retained portion 32 may extend from a widthwise edge of the retained portion 24. The retaining portion 32 may be welded to the retained portion 24. Alternatively, the retaining portion 32 and the retained portion 24 may be integrally formed.

Figure 2B:
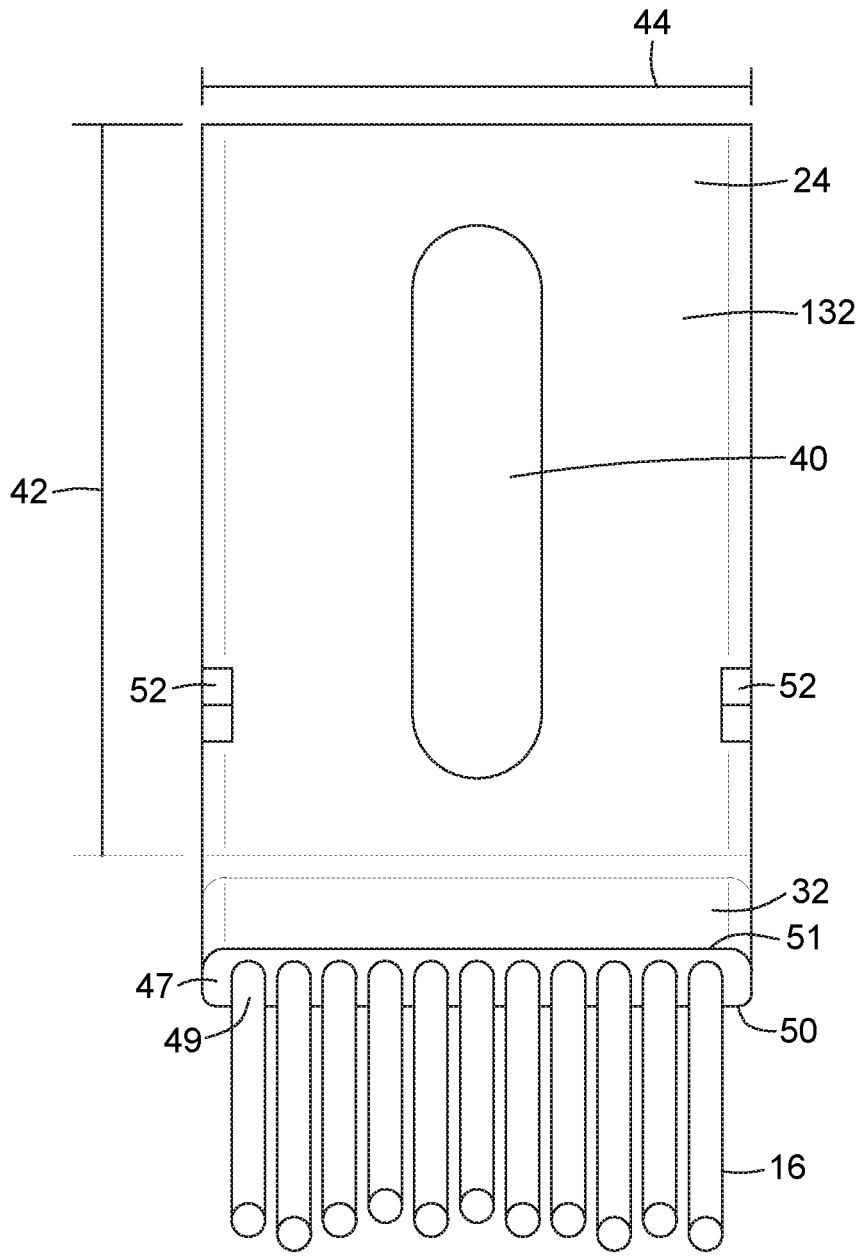
FIG. 2B illustrates a bottom plan view of the broom attachment of FIG. 1A.

According to one example embodiment, and as best seen in the bottom plan view of FIG. 2B, the retaining portion 32 of the support member 8 defines an opening 47 that receives upper extremities 49 of the broom attachment bristles 16. The retaining portion 32 may include opposed sidewalls 50, 51, which partly define the opening 47, and the broom attachment bristles 16 are secured by pressing the bristles between the opposing sidewalls 50, 51.

In the illustrated example, the retaining portion 32 includes of a tubular body that is deformed into an oval-profile cylinder. The long walls of the oval-profile cylinder correspond to sidewalls 50, 51 of the retaining portion 32 that define the opening 47.

According to an example embodiment, and as illustrated in FIGS. 1A to 2B, the broom attachment bristles 16 are arranged side-by-side in a row when being received within the retaining portion 32 of the support member 8. However, it will be understood that other arrangements of broom attachment bristles 16 may be implemented, such as a plurality of rows of bristles 16. Additionally, the positioning of the bristles may be offset from row to row.

The broom attachment bristles 16 of the gutter broom attachment 1 are formed of a material suitable for cleaning an outdoor surface. The broom attachment bristles 16 may be formed of a metallic material. The broom attachment bristles 16 may be steel cables, such as compressed steel cables. Each of the broom attachment bristles 16 may have a diameter that is less than about ½ of an inch. For example, each of the broom attachment bristles 16 may have a diameter of about 3/16 of an inch to about ½ of an inch. While the broom attachment bristles are preferably made of steel cables, it is possible to use other types of materials for the bristles. For example, and without being limited to this lists, other materials can include animal hair, vegetable fibers, synthetic fibers such as nylon, carbon, polyester, peek, polyethylene, polypropylene, PTFE, PVC; other metals, such as aluminum, brass, nickel silver, carbon or stainless steel.

According to an example embodiment, the gutter broom attachment 1 further includes one or more protruding members 52 for physically engaging at least one of the broom and the broom mount. For example, and as illustrated in FIGS.

1 to 2B, the one or more protruding members has the form of at least one engagement tooth 52 that extends from a surface of the retained portion 24 of the support member 8. The engagement tooth 52 has a sharp end which pierces and at least partially embeds itself into the broom unit or the broom mount. The physical engagement of the at least one engagement tooth 52 with the broom or the broom mount further contributes to the retained portion 24 being physically coupled to the at least one of the broom and the broom mount. For example, and as illustrated, the engagement teeth 52 extend downwardly from the retained portion 24 of the support member 8. The engagement teeth 52 are positioned along opposed lengthwise edges of the retained portion 24.

The materials and the size for the gutter broom attachment 1 may be chosen so as to limit its weight. According to one example embodiment, the gutter broom attachment is configured to weigh less than about 5 lbs., and preferably less than 2.5 lbs.

Figure 3:
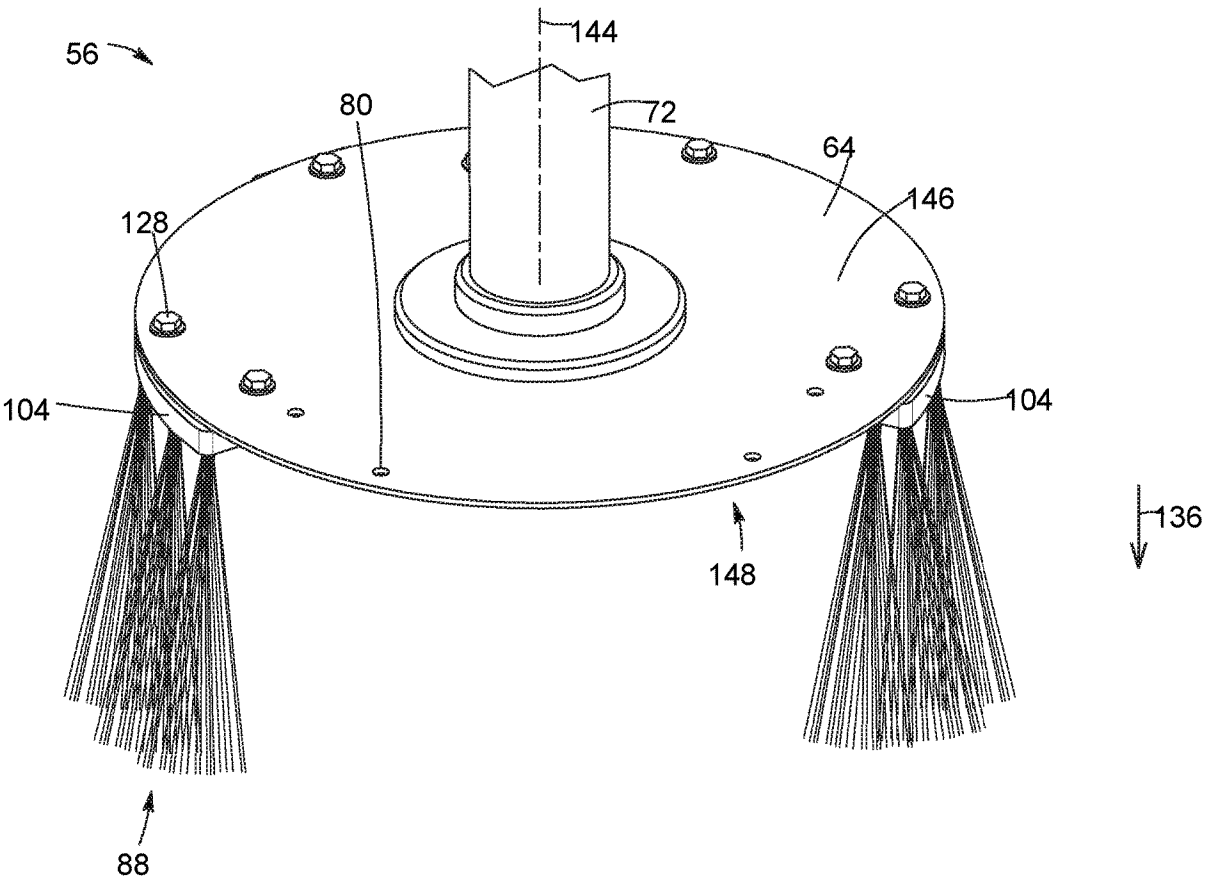
FIG. 3 illustrates a perspective view of a broom mount having mounted thereon sections of a broom.

Referring now to FIG. 3, therein illustrated is a perspective view of a portion of a rotary sweeping assembly 56, which may be part of a street sweeper or other similar device, requiring a rotary broom assembly. The rotary sweeping assembly 56 includes a broom mount 64 and an actuating member 72 coupled to the broom mount 64. The broom mount 64 is adapted to have operatively mounted thereto one or more sections of a gutter broom.

A broom unit 88 herein refers to the collective portions that form a gutter broom that is operational for cleaning an outdoor surface. Portions of the gutter broom may include one or more gutter broom sections 96. Each section 96 further includes a segment 104. The segment 104 hold cleaning bristles 112 of the gutter broom. The segment 104 is also adapted to be operatively mounted to the broom mount 64. A segment 104 may have an arcuate body defining an arc covering an angular range that is less than a full circle. Accordingly, each gutter broom 96 may be generally understood as being arcuate. A plurality of broom sections 96 each having such a segment 104 may be operatively mounted to the broom mount 64 to thereby form a broom unit 88 that covers the full circumference of the broom mount 64. Alternatively, the segment 104 may be an annular member defining a full circle and a single broom section is included in the broom unit 88.

For example, and as illustrated, the broom mount 64 includes a plate-shaped body having formed therein a plurality of fastener openings 80. The plate-shaped body corresponds to a cylindrical drive plate. Broom fasteners project through the fastener openings 80 to join sections of a gutter broom to the broom mount 64. In the illustrated example, a broom unit 88 includes gutter broom sections 96 that each covers a quarter of a full circumference defined by the broom mount 64.

Furthermore, the example illustrated in FIG. 3 shows two gutter broom sections 96 of the broom unit 88 having already been operatively mounted within the rotary sweeping assembly 56. However, at least one section 96 of the broom unit 88 is missing, thereby leaving a portion of the broom mount 64 exposed.

The segment 104 is mounted to the broom mount 64, whereby the cleaning bristles 112 are oriented generally downwardly in a direction 136 from the broom mount 64. The segment 104 may have formed therein one or more broom fastener openings 120 for receiving a broom fastener 128 that directly mounts the segment 104 to the broom mount 64.

The mechanized street sweeping assembly further includes at least one motor (not shown), which is adapted to rotate the actuating member 72. The rotation of the actuating member 72 causes rotation of the broom mount 64, which further causes of rotation of the gutter broom 88 when mounted thereto. Accordingly, the gutter broom 88 is rotated about its axis of rotation 144, which may correspond to an axis of rotation of the broom mount 64 and of the actuating member 72.

Figure 4:
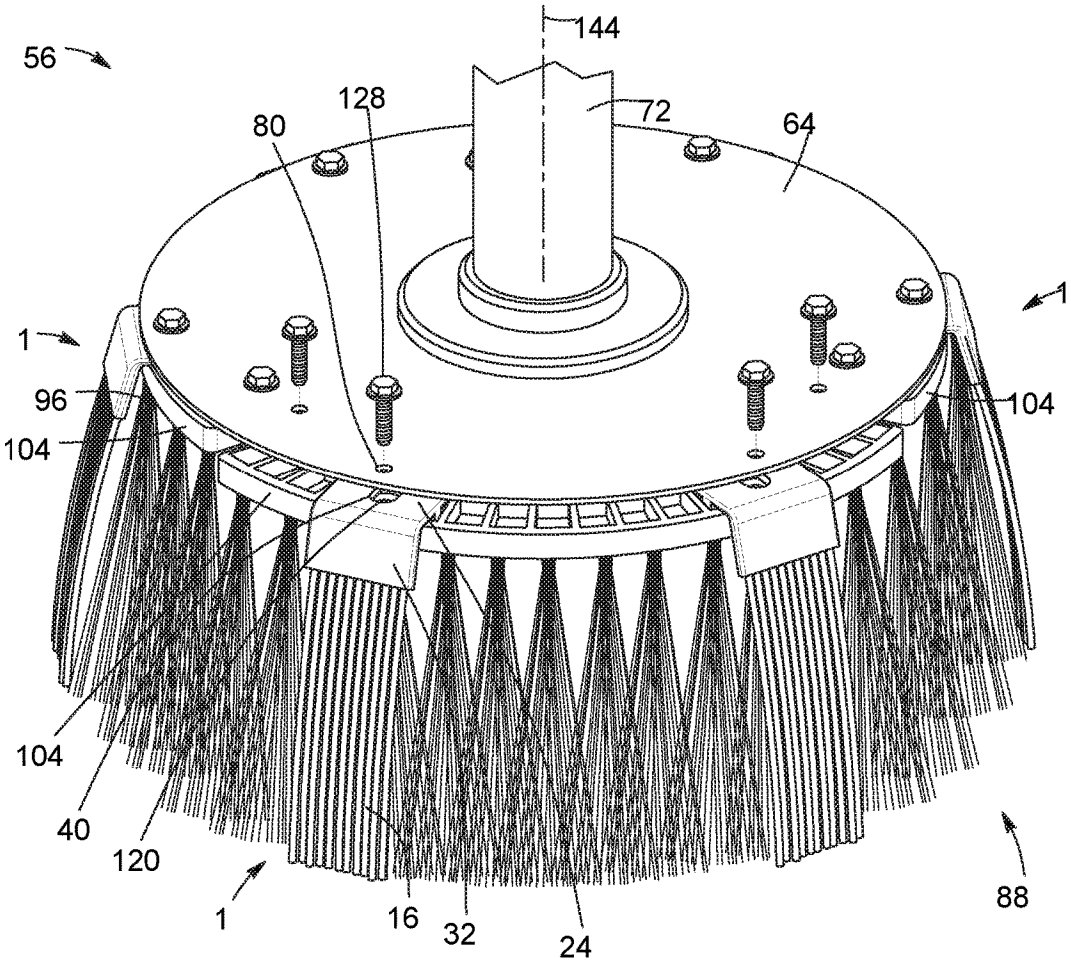
FIG. 4 illustrates a perspective view of the broom mount in which a broom attachment of FIG. 1 is being positioned for attachment.

Referring now to FIG. 4, therein illustrated is a perspective view of the broom mount 64 in which one or more gutter broom attachments 1 are being positioned for operative mounting to the broom mount 64 and broom unit 88. According to the illustrated example, the one or more gutter broom attachments 1 are also being position for direct mounting to at least one of the broom mount 64 and the broom unit 88.

Two gutter broom attachments 1 are also illustrated as already having been directly mounted to the broom mount 64. The retained portion 24 of the support member 8 is positioned between a top surface of a segment 104 of a gutter broom section 96 and a bottom surface of the broom mount 64. It will be appreciated that the retained portion 24 of the gutter broom attachment 1 may be positioned in this way when the gutter broom section 96 is at least partially dismounted from the broom mount 64.

In the example illustrated in FIG. 4, an opening 40 of the retained portion 24 is aligned with a fastener opening 80 of the broom mount 64 and a broom fastener opening 120 of a gutter broom section 96, wherein a single broom fastener 128 is used to directly mount together the broom mount 64, the gutter broom section 96 and the gutter broom attachment 1. The broom fastener 128 may be a bolt type fastener. The bolt-type broom fastener 128 physically engages the broom mount, the retained portion of the broom attachment and the broom unit.

It will be appreciated that the retained portion 24 of the support member 8 of the gutter broom attachment 1 is pinched between the broom mount 64 and the segment 104. This is caused by the bolt-type broom fastener 128 successively physically engaging the broom mount, the retained portion of the broom attachment and the broom unit. This pinching contributes to physically retaining the gutter broom attachment 1 to at least one of the broom mount 64 and the gutter broom 88. For example, the engagement tooth 52 of the retained portion 24 physically pierces the segment 104 to further contribute to physically retaining the retained portion 24 to the broom mount 64 and/or the gutter broom 88.

It will be further appreciated that the retained portion 24 of the support member 8 is operatively mounted in that it rotates with rotation of the broom mount 64 and is secured from fastening of the broom fastener 128, the retained portion 24 is also directly in contact with the broom mount 64. In particular, a top surface 130 of the retained portion 24 represents the broom mount surface of the retained portion 24 that is facing the broom mount 64. The retained portion 24 is also directly in contact with the broom unit 88. In particular, a bottom surface 132 of the retained portion 24 represents the broom unit surface of the retained portion 24 that is facing the broom unit 88.

Figure 5:
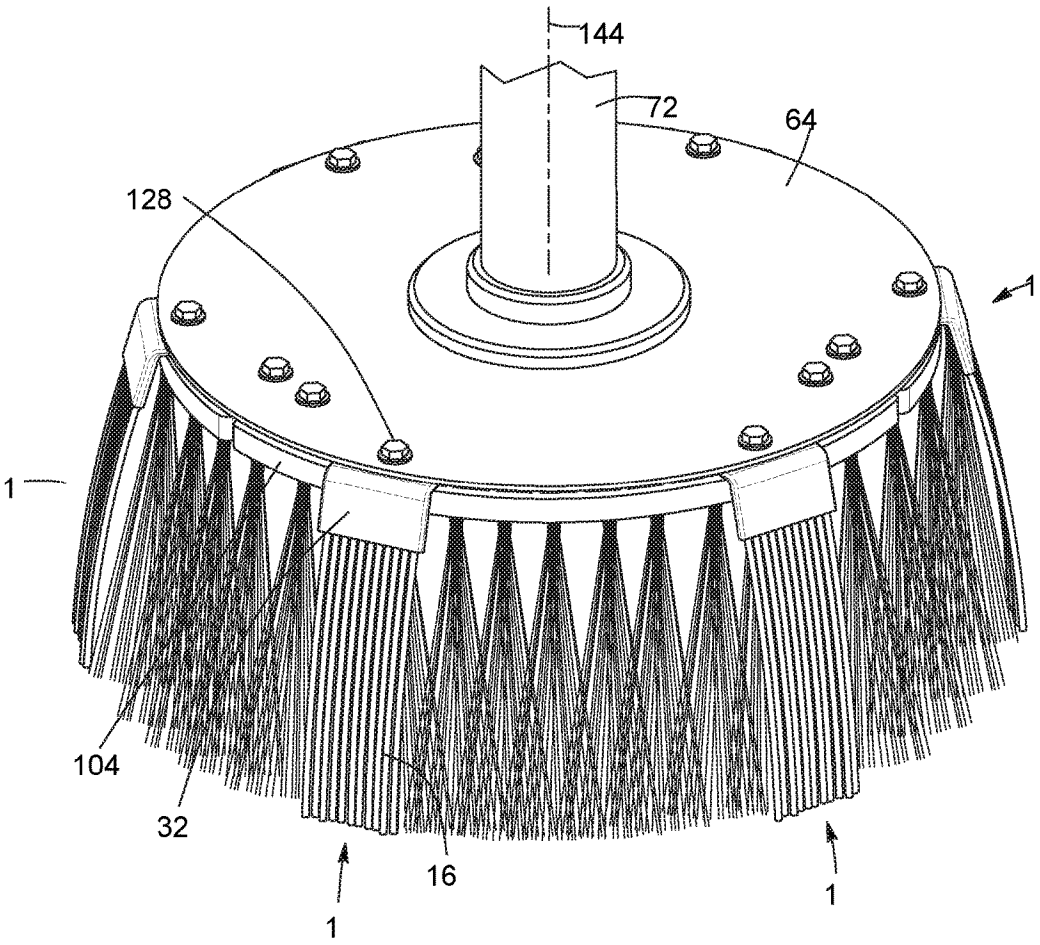
FIG. 5 illustrates a perspective view of the broom mount having mounted thereto a broom attachment of FIG. 1 and broom.

Referring now to FIG. 5, therein illustrated is a perspective view of the portion of the rotary sweeping assembly 56 in which the gutter broom attachment 1 is operatively mounted to both the broom mount 64 and the broom unit 88. The broom unit 88 and the gutter broom attachment 1 are both operatively mounted to the broom mount 64 so as to form together a gutter broom assembly. It will be appreciated that the gutter broom attachment 1 is also directly mounted to both the broom mount 64 and the broom unit 88.

It will be appreciated that when the gutter broom attachment 1 is appropriately mounted, both the cleaning bristles 112 of the broom unit 88 and the broom attachment bristles 16 of the gutter broom attachment 1 are oriented in the downward direction 136 from the broom mount 64. The broom attachment bristles 16 of the gutter broom attachment 1 may be positioned at a greater radial distance away from the rotational axis 144 of the broom unit 88 than a radial distance of the cleaning bristles 112 of the broom unit 88 away from the same axis 144.

In one example embodiment, and as illustrated, the broom attachment bristles 16 of the gutter broom attachment 1 are oriented radially outwardly from the broom mount 64 relative to the cleaning bristles 112 of the broom unit 88. The broom attachment bristles 16 may be oriented in this way according to the embodiment wherein the broom attachment bristles 16 are oriented obliquely with respect to the retained portion 24.

According to one example embodiment, and as illustrated, the broom attachment bristles 16 being arranged side-by-side in a row are oriented tangentially to the broom unit 88 and the broom mount 64. Accordingly the broom attachment bristles 16 are also oriented tangentially to the axis of rotation 144.

According to the illustrated example embodiment, the retained portion 24 of the support member 8 is also positioned radially relative to the axis of rotation 144 outside of a circumference of the broom unit 88. Where the opening 40 of the retained portion 24 is an elongated slot, the elongated slot may be oriented radially relative to the axis of rotation 144. The radial position of the retained portion 24 relative to the axis of rotation 144 may be adjusted during operative mounting of the retained portion 24 to the broom mount 64 and the broom unit 88.

According to some example embodiments, the broom attachment bristles 16 of the gutter broom attachment 1 have different properties than the cleaning bristles 112 of the broom unit 88. The broom attachment bristles 16 of the broom attachment 1 may be longer than the cleaning bristles 112 of the broom unit 88. Additionally or alternatively, the broom attachment bristles 16 of the broom attachment 1 may be more abrasive than the cleaning bristles 112 of the broom unit 88. The broom attachment bristles preferably are thicker and more rigid than the cleaning bristles of the broom unit(s). That said, while it is preferred that the broom attachment bristles have different characteristics than the cleaning bristles of the broom units, it is possible that in some embodiments, the broom attachment and cleaning bristles be made of the same material. It is also possible that in some embodiments, the broom attachment bristles be softer, thinner and/or more flexible than the cleaning bristles.

According to one example embodiment, a plurality of broom attachments 1 may be operatively mounted to the rotary sweeping assembly 56. These broom attachments 1 may be dispersed angularly about the circumference of the broom mount 64. The broom attachments 1 may be positioned to be equally angularly spaced apart about the circumference of the broom mount 64.

In one example embodiment, and as illustrated the totality of the gutter broom attachments 1 mounted to the assembly 56 cover less than a full circumference of the broom mount 64. That is, some portions of the circumference of the broom mount 64 do not have a gutter broom attachment 1.

In another example embodiment, the broom attachments 1 may be sized and positioned so as to cover the full circumference of the broom mount 64.

While the broom attachment 1 is directly mounted to both the broom 88 and the broom mount 64 by alignment of the opening 40 of the retained portion 24 with the fastener opening 88 of the broom mount 64 and the fastener opening 120 of the segment 104 and using a single broom fastener 128 in the illustrated example, it will be understood that the broom attachment 1 may be directly mounted to only one of the broom 88 and the broom mount 64 according to various configurations. For example, the broom attachment 1 may be directly mounted only to the broom mount 64 using a fastener that is separate from the fastener for mounted the broom mount 64 to segment 104 of the gutter broom 88. Alternatively, the broom attachment 1 may be directly mounted only to the gutter broom 88 using a fastener that is separate from the fastener for mounting the broom mount 64 to the segment 104 of the gutter broom 88.

In other example embodiments, the gutter broom attachment 1 may be operatively mounted without its retained portion being pinched between the broom mount 64 and the segment 120 of a gutter broom section 96.

As illustrated, the broom mount 64 includes a circular drive plate having opposed top surface 146 and bottom surface 148. In the example illustrated in the figures, the top surface 130, corresponding to a broom mount surface, is directly mounted to the bottom surface 160 of the broom mount 64.

According to an alternatively example embodiment, the retained portion 24 is disposed on a top surface 146 of the broom mount 64 whereby the bottom surface 132 of the retained portion 24 is supported by the top surface 146. Accordingly, the bottom surface 132 represents both a broom mount surface and a broom unit surface. Accordingly, the retained portion 24 is only operatively mounted to the broom unit 88.

In yet another example embodiment, the retained portion 24 may be directly mounted to the broom unit 88 and only operatively mounted to the broom mount 64. For example, the retained portion 24 may be mounted to a circumferential outerwall of a segment 104 of the broom unit 88 and is operatively mounted to the broom mount 64 through mounting of the broom unit 88 to the broom mount 64.

According to a method for operating a street sweeper, at least one gutter broom attachment 1 described herein according to various example embodiments is provided. The at least one gutter broom attachment 1 is operatively mounted onto broom mount 64 of a rotary sweeping assembly 56 of the street sweeper. The method may further include operatively mounting the broom unit 88 onto the broom mount 64. The operative mounting of the at least one gutter broom attachment 1 to the broom mount 64 may include directly mounting the at least one gutter broom attachment 1 to at least one of the broom mount 64 and the broom unit 88.

The retained portion 24 may be mounted to either one of a top surface 146 and a bottom surface 148. Alternatively, the retained portion 24 may be directly mounted onto only the broom unit 88 and the broom unit 88 is further directly mounted onto the broom mount 64.

According to one example embodiment, and as illustrated in FIG. 4, a retained portion 24 of the support member 8 of the gutter broom attachment 1 is positioned between a top surface of a segment 104 of a gutter broom section 96 and a bottom surface 160 of the broom mount 64. Furthermore, an opening 40 of the retained portion 24 may be aligned with a fastener opening 80 of the broom mount 64 and a broom fastener opening 120 of a gutter broom section and a single broom fastener 128 is used to mount together the broom mount 64, the gutter broom section 96 and the gutter broom attachment 1. The broom fastener 128 projects through the slot 40 of the retained portion while fastening the broom unit 88 to the broom mount 64. Accordingly, fastening the gutter broom 96 to the broom mount 64 using the fastener 128 causes the retained portion 24 to be pinched between the broom mount 56 and the segment 104 of the gutter broom section 96.

The radial position of the retained portion relative to the broom unit 88 and/or the broom mount 64 may be adjusted. This adjustment depends on the size, type, manufacturer or model of the broom unit 88 or broom mount 64, such as making the adjustment to align the slot with differently located fastener openings 80 and/or broom fasteners openings 120 [128]. This adjustment may also be made to adjust a radial position of the gutter broom bristles 16 of the gutter broom attachment 1 relative to the bristles 112 of the broom unit 88. Adjusting the radial position of the bristles 16 may affect performance of the broom unit 88. This adjustment corresponds to adjusting the position of the broom fastener 128 within the elongated slot 40 of the retained portion 24.

Where a gutter broom section 96 is already operatively mounted onto a broom mount 64, the method may further include at least partially dismounting a segment 104 of the broom section 96 from the broom mount 64 to allow appropriate positioning of the at least one gutter broom attachment 1. This may be the case where the at least one gutter broom attachment 1 is being used to replace other gutter broom attachments 1 that have already been mounted. This may also be the case where the at least one gutter broom attachment 1 is being used to retrofit a rotary sweeper assembly 56 that previously did not have gutter broom attachments 1 mounted thereto.

Once the at least one gutter broom attachment 1 is appropriately operatively mounted to the broom mount 64 and the broom unit 88 is also appropriately operative mounted to the broom mount 64, the rotary sweeper assembly 56 is operated by positioning the broom unit 88 and the gutter broom attachment 1 over an outdoor surface to be cleaned. The broom mount 56 is further rotated by rotating the actuating member 72. This rotation causes rotation of the bristles 112 of the gutter broom 88 and the bristles 16 of the gutter broom attachment 1, thereby providing a cleaning action of the outdoor surface.

Figure 6:
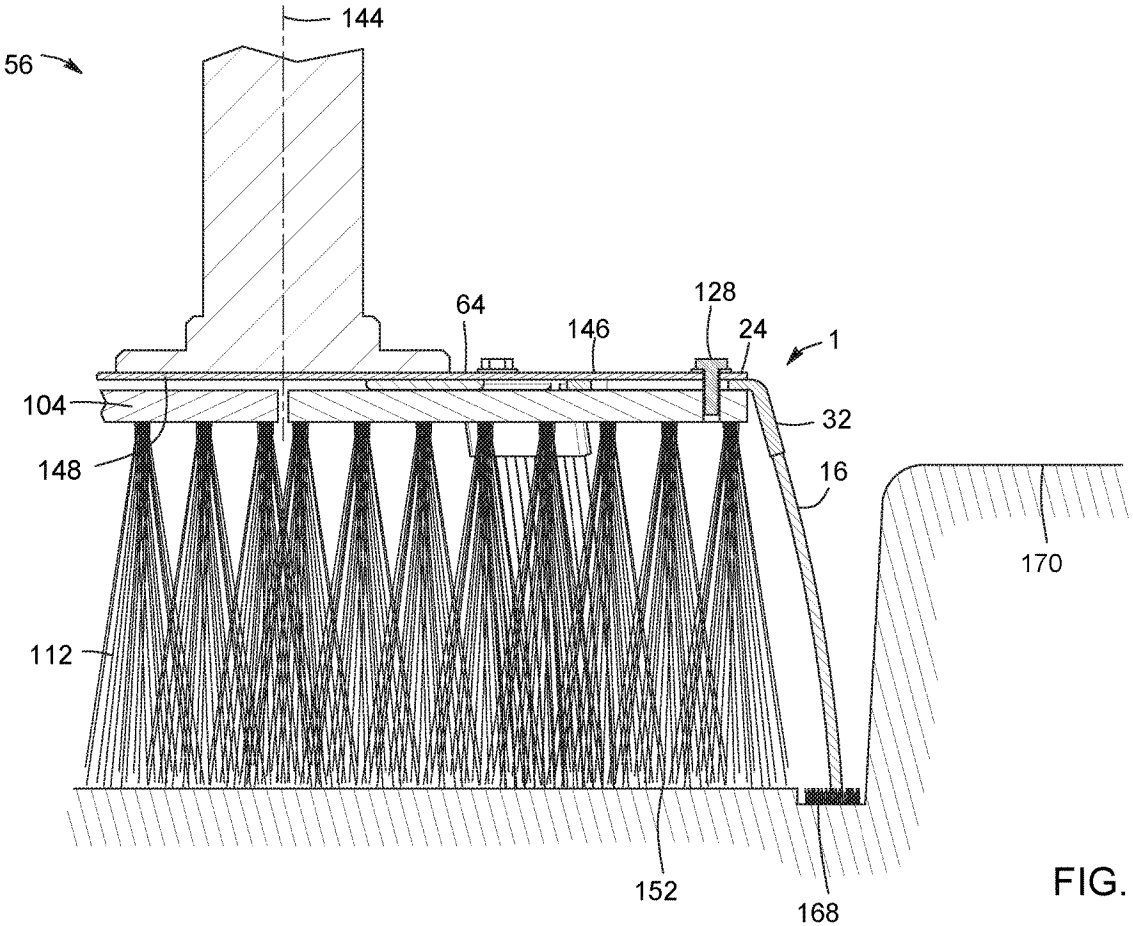
FIG. 6 illustrates a section view of a broom and a broom attachment of FIG. 1 in operation for cleaning an outdoor surface.

Referring now to FIG. 6, therein illustrated is a section view of a portion of the rotary sweeper assembly 56 in operation while having a plurality of gutter broom attachments 1 mounted thereto. It will be appreciated that the broom attachment bristles 16 of the gutter broom attachment 1 are located at a greater radial distance away from the axis of [ration] rotation 144 than the cleaning bristles 112 of the broom unit 88.

In the illustrated example, the rotary sweeper assembly 56 is positioned in proximity of the side of a street that is formed of a street surface 152, a sidewalk [160] 170 and a gap portion 168. The ditch portion 168 is located between an edge of the street surface 152 and the sidewalk 170 and may correspond to a gap between the paving of the street and the start of the sidewalk 170. It was observed that the gap portion 168 is often difficult to reach for cleaning using a typical gutter broom 64. It was further observed that weeds and other plants often grow in of the gap 168, which may require more thorough cleaning.

Continuing with FIG. 6, the cleaning bristles 112 of the broom unit 88 are positioned over the street surface 152. The broom attachment bristles 16 of the gutter broom attachment 1 are positioned within the gap portion 168 and may extend into the gap portion 168. It was observed that when the rotary sweeper assembly 56 is operated, the broom attachment bristles 16 are effective for cleaning a surface of the gap portion 168 and for removing solids disposed in the gap portion 168. The diameter of the broom attachment bristles 16 may be chosen to be sufficiently small so that the broom attachment bristles 16 can enter the gap portion 168. The retained portion 24 preferably extends parallel to the broom mount, and thus also preferably parallel to the surface to be cleaned. Typically, the rotary sweeper assembly has an axis of rotation that is perpendicular to the surface to be cleaned.

In one example embodiment, a broom unit is permanently mounted with at least a first set of bristles and a second set of bristles. The first set of bristles may have the properties of the broom attachment bristles 16 of the gutter broom attachment 1 described herein according to various embodiments and the second set of bristles may have the properties of the cleaning bristles 112 of the broom unit 88 described herein. The first set of bristles may be positioned at a greater radial distance from the axis of rotation of the gutter broom than the second set of bristles. The broom unit 88 having the first and second set of bristles is effective for cleaning a side of a street.

It was observed that one drawback of existing gutter brooms is that they are sized to fit to the broom mount of a specific street sweeper. That is, a broom mount of a particular size, model, manufacturer or type must be matched with a gutter broom specific to that broom mount. Thus an entity (ex: company or municipality) owning or operating street sweepers from different manufacturers must keep spare gutter brooms of various sizes, model, manufacturers or types, which are bulky and monopolize large areas of storage space.

It was observed that another drawback of existing gutter brooms is that they are often poorly adapted to perform both street cleaning and gutter cleaning (ex: cleaning the gap portion between a street surface 152 and a sidewalk 160). A typical workaround is to alternate between using first gutter brooms having smaller, more flexible bristles adapted for cleaning the street and using other gutter brooms having sturdier bristles for cleaning the gutter. Such a workaround is time consuming as a same area must be cleaned twice using the two types of brooms.

The gutter broom attachment 1 described herein according to various example embodiments may advantageously be used in combination with a variety of gutter brooms and broom mounts of different sizes, models, manufacturers and types. For example, the elongated slot 40 of the retained portion 24 of the gutter broom attachment 1 allows the position of the gutter broom attachment 1 to be adjusted when being mounted in order to align with fastener openings that may be located differently in different gutter brooms and/or broom mounts 64.

The advantage of being capable of use in combination with a variety of gutter brooms and broom mounts provide the additional advantage of space savings when storing the gutter broom attachment 1. It was further observed that the shape of the retained portion 24 and retaining portion 32 allow a plurality of gutter broom attachments to be stacked when being stored.

The gutter broom attachment 1 has properties that allows it be limited in weight when compared to other gutter brooms that are highly abrasive. For example, by angularly dispersing the gutter broom attachment 1 so as to cover less than a full circumference of the broom mount, the weight added to the gutter broom assembly is managed while remaining effective for cleaning. Reducing the weighted added also allows for energy savings when operating the street sweeper.

The gutter broom attachment 1 being operatively mountable to a broom unit and/or a broom mount allows two types of bristles (broom attachment bristles 16 and cleaning bristles 112) to be used simultaneously during a street sweeping operation while being effective to clean a street surface and a gutter at the same time. This provides time savings in reduction of time for changing between different types of gutter brooms and having to clean an area only once.

Appropriately choosing a diameter and length of the broom attachment bristles 16 of the gutter broom attachment 1 allows the bristles 16 to be effective to enter a gutter (ex: gap portion 168). The effectiveness may be increased by further appropriately orienting the bristles 16. The effectiveness may also be increase by further appropriately choosing a sufficiently rigid material for forming the bristles 16. In particular, the bristles 16 are effective for removing plant growth and other solid particles from the gutter when used in combination with a typical gutter broom.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A broom assembly, comprising:

a rotary sweeper assembly including a circular broom mount having a surface and at least one broom section mounted to the broom mount, each of the at least one broom section including a segment holding cleaning bristles;

a broom attachment, comprising:

a plurality of gutter bristles; and a support member having a retained portion and a retaining portion, the plurality of gutter bristles extending from the retaining portion;

the retained portion being operatively mounted to the surface the broom mount, such that the gutter bristles of the broom attachment extend outwardly relative to the cleaning bristles of the at least one broom section, the broom mount having an axis of rotation that extends substantial perpendicular to the surface of the broom mount;

wherein the gutter bristles are positioned at a greater radial distance away from the axis of rotation of the broom mount than the cleaning bristles of the at least one broom section; and a broom fastener projecting through the broom mount, the retained portion and the at least one broom section, thereby securing the broom attachment to the broom mount and the at least one broom section.

2. The broom assembly according to claim 1, wherein a distance of the gutter bristles of the broom attachment away from the axis of rotation of the broom mount is adjustable.

3. The broom assembly according to claim 1, wherein the gutter bristles are arranged in at least one row and wherein the at least one row is spaced away from a last row of cleaning bristles of the at least one broom segment.

4. The broom assembly according to claim 1, wherein the broom attachment is one of a plurality of broom attachments operatively mounted to the broom mount, the plurality of broom attachments being spaced angularly apart about the axis of rotation of the broom mount.

5. The broom assembly according to claim 1, wherein the broom fastener includes a bolt.

6. The broom assembly according to claim 1, wherein the broom attachment is pinched between the broom mount and the broom section.

7. The broom assembly according to claim 1, wherein the surface is a bottom surface of the broom mount.

8. The broom assembly according to claim 7, wherein the retained portion is pinched between the broom mount and the at least one broom section.

9. The broom assembly of claim 1, wherein the retained portion is directly mounted to at least one of the broom mount and the at least one broom section.

10. The broom assembly of claim 1, wherein the retained portion of the support member has a broom mount surface for facing the broom mount, the broom mount surface being mounted to the broom mount.

11. The broom assembly of claim 1, wherein the retained portion of the support member has a broom section surface facing the at least one broom section, the broom section surface being mounted to the at least one broom section.

12. The broom assembly of claim 1, wherein the retained portion of the support member comprises a metallic plate.

13. The broom assembly of claim 1, wherein the retained portion of the support member has a slot formed therein that receives a broom fastener.

14. The broom assembly of claim 13, wherein the slot is elongated and extends radially relative to the at least one broom section.

15. The broom assembly of claim 1, wherein the retained portion comprises a tooth for gripping the at least one broom section.

16. The broom assembly of claim 1, wherein the retaining portion comprises an opening that receives upper extremities of the gutter bristles.

17. The broom assembly of claim 16, wherein the retaining portion comprises opposed sidewalls, the gutter bristles being secured to the retaining portion by pressing the upper extremities between the opposed sidewalls.

18. The broom assembly of claim 1, wherein the gutter bristles are arranged in at least one row.

19. The broom assembly of claim 1, wherein the gutter bristles comprise compressed steel cables.

20. The broom assembly according to claim 19, wherein the gutter bristles have a diameter of about 3/16 of an inch to about ½ of an inch.

21. The broom assembly of claim 20, wherein the broom attachment weighs less than about 2.5 lbs.

22. The broom assembly according to claim 1, wherein the broom mount comprises a cylindrical drive plate.

23. The broom assembly according to claim 22, wherein the at least one broom section comprises an annular member.

* * * * *